US007353945B2

(12) United States Patent
Roderwieser

(10) Patent No.: US 7,353,945 B2
(45) Date of Patent: Apr. 8, 2008

(54) FOLDED PACK

(75) Inventor: Herbert Roderwieser, Lindlar (DE)

(73) Assignee: Patent-Trehand-Gesellschaft für elektrische Glühlampen mbH, Munich (DE)

( * ) Notice: Subject to any disclaimer, the term of this patent is extended or adjusted under 35 U.S.C. 154(b) by 366 days.

(21) Appl. No.: 11/212,775

(22) Filed: Aug. 29, 2005

(65) Prior Publication Data

US 2006/0049071 A1 Mar. 9, 2006

(30) Foreign Application Priority Data

Sep. 8, 2004 (DE) ..... 20 2004 014 027 U

(51) Int. Cl.
*B65D 85/42* (2006.01)

(52) U.S. Cl. ..... 206/418; 206/592

(58) Field of Classification Search ..... 206/418, 206/419, 420, 421, 446, 591, 592, 593, 594; 229/87.02

See application file for complete search history.

(56) References Cited

U.S. PATENT DOCUMENTS 2,692,077 A * 10/1954 Kuhlman ..... 206/521
2,798,596 A * 7/1957 Emmons ..... 206/418
3,973,675 A * 8/1976 Brand et al. ..... 206/418
4,498,580 A * 2/1985 Getz et al. ..... 206/418
4,880,114 A * 11/1989 Korte ..... 206/418
5,117,976 A * 6/1992 Whitt et al. ..... 206/705
5,358,170 A * 10/1994 Van Hest ..... 229/87.02
5,730,289 A * 3/1998 Cappels ..... 206/434
5,971,265 A * 10/1999 Collins ..... 229/120.13
6,877,606 B2 * 4/2005 Hardy ..... 206/419
2003/0085144 A1 * 5/2003 Bakx ..... 206/419

FOREIGN PATENT DOCUMENTS

DE 197 20 729 11/1998
EP 0 878 411 11/1998

* cited by examiner

*Primary Examiner*—David T Fidei
(74) *Attorney, Agent, or Firm*—William E. Meyer

(57) ABSTRACT

The folded pack consists of one piece, this part being produced from a substantially rectangular strip of board-like material (board blank), which is folded at fold lines (2-7) running transversely with respect to its longitudinal axis and spaced apart along the axis, the base part wrapping around the object to be packed by at least 360° and consisting of a front wall (8), a base part (9) and two side walls (10, 11) for holding the object (21) to be packed, the pack surrounding the elongated object in the shape of a parallelepiped, at least one viewing window (18) being cut out of the front wall (8) and one side wall (11), at least one edge zone of the viewing window (17) providing a holding function for the object (21).

11 Claims, 3 Drawing Sheets

FOLDED PACK

TECHNICAL FIELD

The invention is based on a folded pack of board-like material for an elongated object, in particular having at least one lateral bulge. It deals in particular with a folded pack for elongated objects, such as approximately tubular or cylindrical objects, for example lamps with one or two bases, in particular incandescent lamps or fluorescent lamps with one or two bases.

Furthermore, the invention relates to such a folded pack filled with an object, and to the board blank used for the production of the folded pack.

BACKGROUND ART

DE-A 197 20 729 discloses a two-part folded pack for an elongated object, in particular an incandescent lamp, which is conceived as a suspended visible pack.

The disadvantage with this folded pack is that it is poorly suited to automation.

DISCLOSURE OF THE INVENTION

It is an object of the present invention to provide a folded pack of board-like material for an elongated object, in particular having at least one lateral bulge which pack is well suited to automation.

This object is achieved by the following features:

the folded pack is fabricated from one piece, this part being produced from a substantially rectangular strip of board-like material (board blank), which is folded at fold lines running transversely with respect to its longitudinal axis and spaced apart along the axis, the base part wrapping around the object to be packed by at least 360° and consisting of a front wall, a base part and two side walls for holding the object to be packed, the pack surrounding the elongated object in the shape of a parallelepiped, at least one viewing window being cut out of the front wall and one side wall, at least one edge zone of the viewing window providing a holding function for the object.

Particularly advantageous refinements will be found in the dependent claims.

The invention is based on a single-part folded pack made of board-like material. This board blank wraps around the product, generally by more than 360°. It consists of a front wall, two side walls and a base part with a tab. The outline of all the parts is substantially rectangular, the dimensions corresponding approximately to the respective projection of the objects to be encased.

With this basic concept of a single-part wound pack, automation is made considerably easier, in particular an identical pack can be used for objects which have slightly different dimensions.

The term board-like material comprises paperboard, laminated plastic film and similar materials, as are usual for packs. In particular, a high proportion of waste paper can now be used.

In particular, one of the parts, normally the base part, comprises an extension which has a suspension opening.

In detail, what is concerned is a folded pack of board-like material for an elongated object, in particular having at least one lateral bulge, the folded pack being fabricated from one piece. This part is produced from a substantially rectangular strip of board-like material (board blank), which is folded at fold lines running transversely with respect to its longitudinal axis and spaced apart along the axis, this part wrapping around the object to be packed by at least 360° and consisting of a front wall, a base part and two side walls for holding the object to be packed, the pack surrounding the elongated object in the shape of a parallelepiped, at least one viewing window being cut out of the front wall and one side wall, at least one edge zone of the viewing window providing a holding function for the object. In the simplest case, the object is clamped in and pulled tightly by the edge zone as if by a strap.

In addition, the lateral edge of the edge zone can be used as a stop for any lateral bulge of the object.

In general, the viewing window and/or the edge zone run transversely with respect to the longitudinal axis in the shape of a strip. Of course, it can also run obliquely, so that the viewing window acts, for example, as if cut out in a wedge shape.

In the region of the viewing window, the original material of the board blank is pressed against the base part and the other side wall and is therefore arranged behind the object. At the same time, it is folded along the fold line lying between these.

It is important for the function of the folded pack that, in the region of the edge zone, the material of the board blank remains arranged in front of the object, the material being folded forward along two new fold lines which are different from the one original fold line. The original fold line lies between the two new fold lines. In this case, part of the original side wall which is adjacent to the base part is guided along on the base part, that is to say it is bent back through 180° toward the base part, this part being used as an adhesive surface to be joined to the base part, while the remaining area is tautened around the object as a strap surface. The thing here is that the width b of the adhesive area goes beyond the projection of the object, which is generally a cylinder. Expressed in another way, the sum of the projection p of the object on the base part and of the width b of the adhesive area on the base part is greater than the width w of the base part. With this design, for example, simple cylindrical objects such as linear fluorescent lamps can be held.

Particularly secure holding is achieved in the case of objects with a lateral bulge, in that the edge zone rests on the object and one of its two edges forms the stop for the lateral bulge of the object.

A particular advantage of the folded pack manifests itself if it has two viewing windows which are arranged in such a way that its edge zones generally form a stop for two bulges at the ends of the object to be packed or for a central bulge. For instance, the object is a tubular incandescent lamp, often called a soffit lamp, which has a central lateral base or, alternatively, two separate base parts at the ends.

Additional protection for the object is achieved in that the overall length of the parallelepiped exceeds the overall length of the object to such an extent that the ends of the object are seated at some depth in the pack. In this way, it is possible to dispense with lid parts of the pack, which would be fitted only with additional expenditure (additional trim). Of course, however, cap parts can also be fitted to the lid sides in various ways known per se.

In a similar way, additional protection for the object is also achieved by the width of the complete first side wall exceeding the width of the object in this direction to such an extent that the object is located at a depth in the pack. Typical projections which are sufficient for a protective action are 5 to 15 mm.

In order to permit the pack to be suspended, the base part can have an extended tongue with a suspension opening (27). The tongue can be adhesively bonded on or fitted integrally.

The unity of the folded pack is achieved in that a tab on one side edge, for example on the base part, is adhesively bonded to the other free end. The holding action is primarily achieved by the base part being connected at least to the adhesive area of one side wall by means of adhesive material. In the region of the viewing window, the folded-back material can be adhesively bonded to the base part and the complete side wall.

In general, two to four viewing windows are provided, it not being necessary for each viewing window then to be equipped with an edge zone. Two viewing windows each having edge zones are preferred. The packed object can be identified such that a marking or the like is located precisely in the region of a viewing window. A bar code can also be applied here. Thus, for a large number of similar objects, such as various lamp types, exactly the same pack can be used, since the identification is applied to the packed object itself.

A board blank for a folded pack is substantially rectangular and has folding lines which divide the side walls from the front wall and the base part.

The desire for protection is also directed to a folded pack which is fitted with an object, in particular a lamp with a base on one side or two sides. This folded pack is advantageously used for the suspension of self-service goods. For this purpose, the base part can have an extension which has a suspension opening. In particular, a loadbearing opening is achieved by a double layer of board being used here.

In particular, the customer is given an understanding of the object in that the front wall has a plurality of viewing windows.

Advantageously, the base part has a continuous or interrupted tab for adhesive bonding. The tab is attached to the base part via a fold line. It is fixed to the opposite complete side wall by means of adhesive bonding, which completes the encasement of the object by more than 360°. Of course, the tab can also be integrally molded on the side wall.

The present invention also comprises the board blank for a folded pack corresponding to the basic and advantageous refinements. Finally, the invention also comprises a folded pack which is fitted with the object to be packed.

One area of application for this pack is lamps, which can have one-piece or two-part lateral bases.

BRIEF DESCRIPTION OF THE DRAWINGS

In the following text, the invention is to be explained in more detail by using a number of exemplary embodiments. In the figures.

BEST MODE FOR CARRYING OUT THE INVENTION

Figure 1:
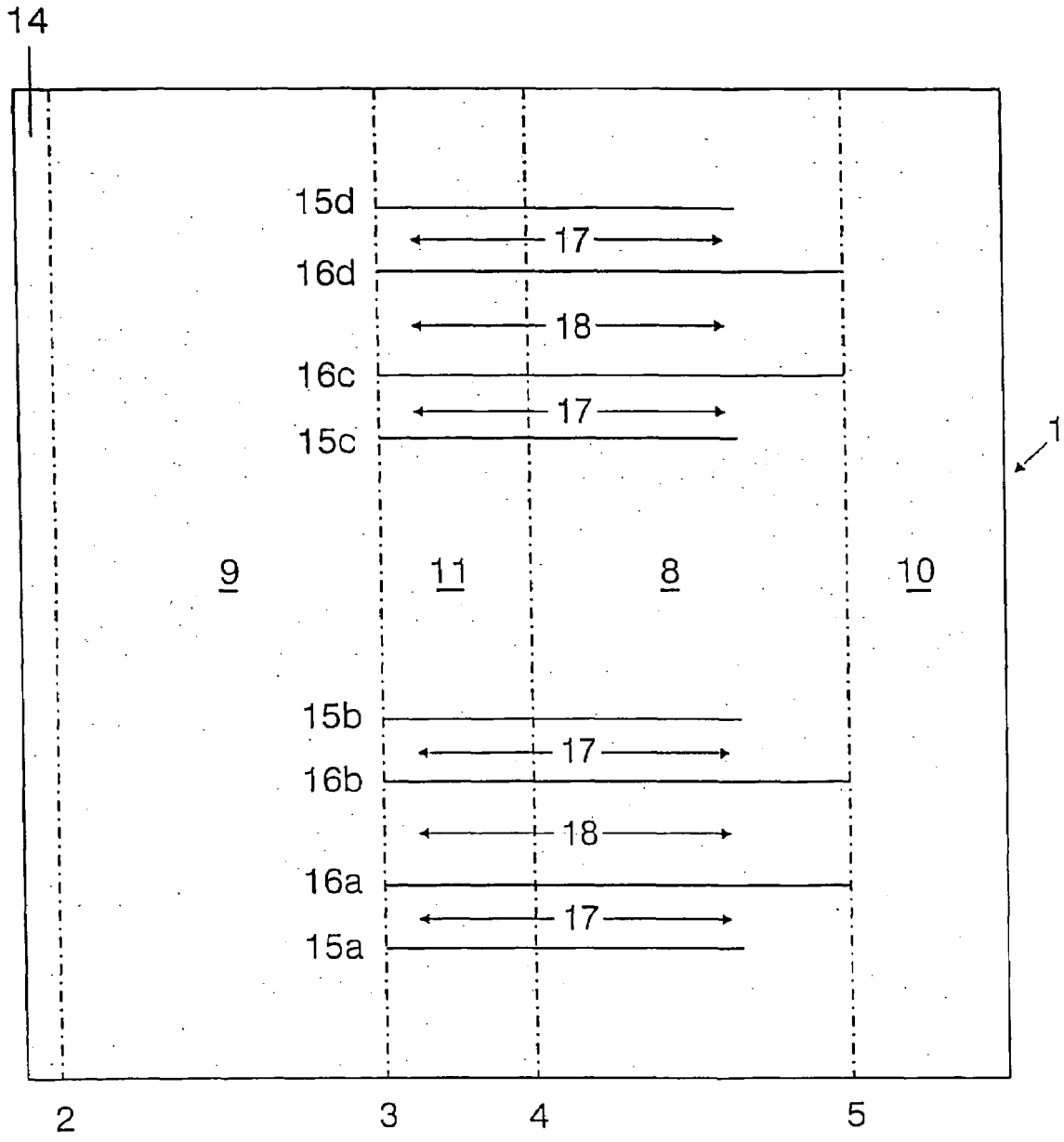
FIG. 1 shows a board blank for producing a folded pack for a halogen incandescent lamp with bases on two sides.

In FIG. 1, the board blank 1 of a folded pack for an elongated object, a fluorescent lamp or else an incandescent lamp, is shown. It is a rectangular folded strip of board-like material which is subdivided by a plurality of folding lines 2 to 5 which run parallel to the longitudinal axis of the board blank 1. A front wall 8, a base part 9 and, lying between them, a functional side wall 11 and then a complete side wall 10 are in each case separated from one another by a fold line. In addition, a tab 14 is attached laterally to the base part 9 after a fold line 2.

The front wall 8 and the functional side wall 11 have cuts (15, 16) which run transversely with respect to the longitudinal axis. They can also be made somewhat obliquely. These cuts are used for the provision of viewing windows, which are arranged in such a way that they are able to expose the view of part of the lamp. The part of the lamp which bears a marking is advantageously exposed, so that a dedicated marking on the pack itself can be dispensed with.

Some of the cuts (15*a* to 15*d*) extend completely over the functional side wall 11 but only part of the front wall 8. Some more of the cuts (16*a* to 16*d*) extend over the complete width of the functional side wall 11 and front wall 8. The incomplete cuts 15 are assigned as edges to the edge zone 17. The complete cuts 16 are assigned as a boundary to the viewing windows 18.

Figure 2:
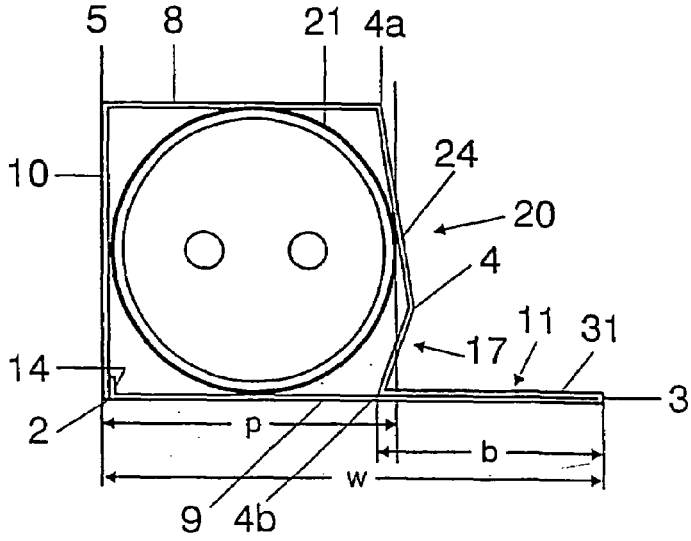
FIG. 2 shows the section through a pack with a fluorescent lamp in the interior.

A section through a pack 20 with fluorescent lamp 21 contained is shown in FIG. 2. The section is made in the region of an edge zone 17, which is subdivided into an adhesive area 31 and a strap area 24. The projection p of the lamp 21 onto the base part 9 is longer than the difference between the width w of the base part and the width b of the adhesive area 31. In this way, a certain amount of tension is exerted on the lamp 21, so that, apart from resting on the complete side wall 10 and the front part 8, it also rests on a further point in the region of the strap area 24, which is induced by the original fold line 4 and the new fold lines 4*a*, 4*b*.

Figure 3:
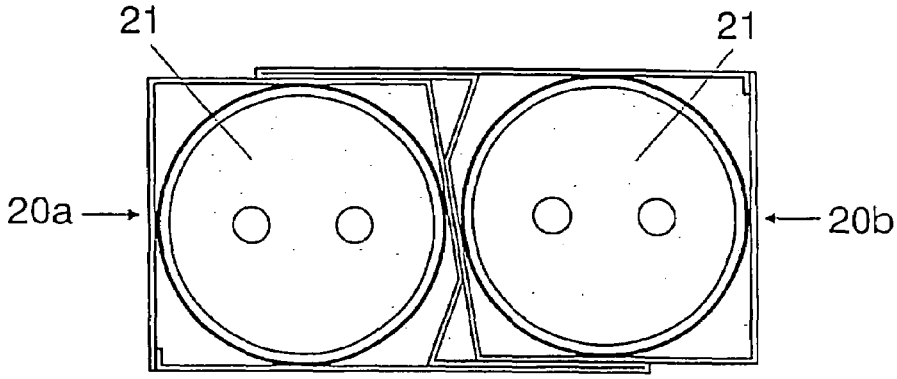
FIG. 3 shows two stacked packs according to FIG. 2.

Given this arrangement, there remains no residue of the imaginary functional side wall 11 (originally a mirror image of the side wall 10 which has remained complete). Therefore, these packs can be stacked in an ideal space-saving manner in that, for example, two packs 20*a*, 20*b* with two fluorescent lamps 21 can be stacked inversely in relation to each other, for this see FIG. 3.

Figure 4:
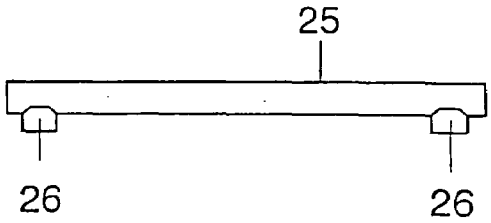
FIG. 4 shows an incandescent lamp with bases on two sides.

Particular advantages also result in the case of incandescent lamps of the soffit type with a lateral base part. FIG. 4 shows such a lamp with cylindrical bulb 25 and two base parts 26 in the vicinity of the ends.

Figure 5:
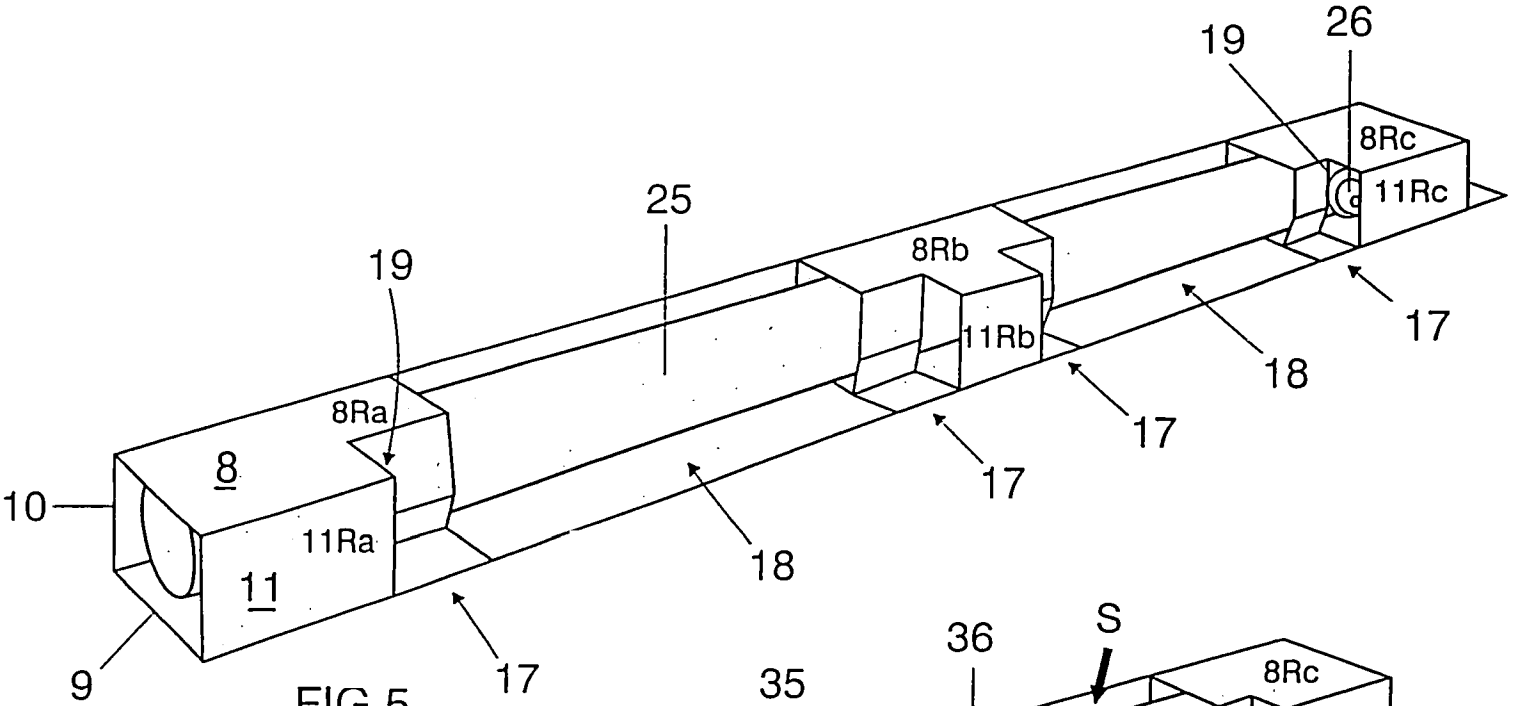
FIG. 5 shows a folded pack with an incandescent lamp having bases on two sides contained therein.

The associated pack is shown in FIG. 5. The pack, which is parallelepipedal in principle, has a base part 9 and a complete side wall 10. Of the front wall 8 and the functional side wall 11 there remain in each case three residual sections 8Ra, 8Rb, 8Rc and 11Ra, 11Rb, 11Rc. The first edge zone 17 is attached to the first residual section of side wall and front wall 11Ra and 8Ra. The first residual section 11Ra, 8Ra accommodates the first base part 26 (not visible). The edge 19 of the first edge zone 17 is used as a stop. There follows a wide viewing window 18, which is implemented by folding back a section of the front wall 8 and of the functional side part 11. There then follow again an edge zone 17 and a residual section 11Rb and also a further edge zone 17. These three parts have no direct function. Their purpose will become clear only in conjunction with the two following figures.

Finally, there follows a further viewing window 18 and a further edge zone 17, whose edge 19 finally serves as a stop for the second base part 26, which is accommodated in the adjacent last residual section 8Rc, 11Rc.

Figure 6:
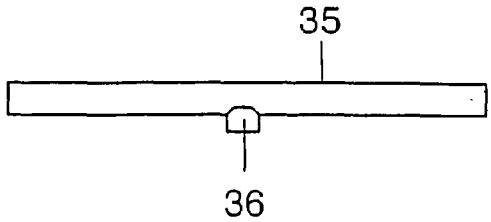
FIG. 6 shows an incandescent lamp with a base on one side.

FIG. 6 shows a further soffit lamp, this time with a lower wattage, in which the lateral base part 36 is fitted as a single part in the center of the bulb 35.

Figure 7:
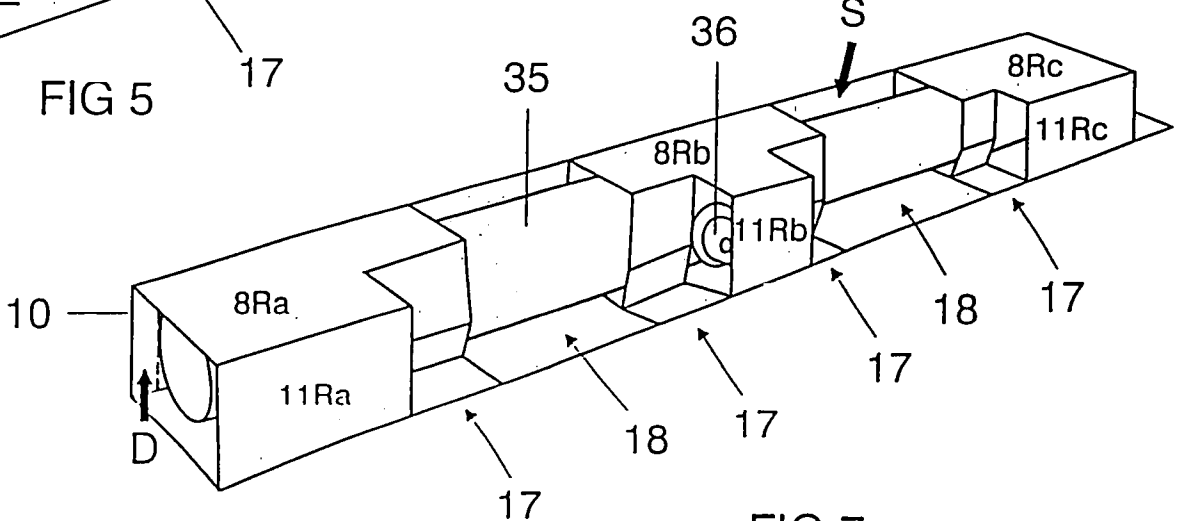
FIG. 7 shows a folded pack with an incandescent lamp having a base on one side contained therein.

The associated pack is shown in FIG. 7. This is conceived in exactly the same way as the pack for the two-part base part. However, the critical difference is that, here, the single base part 36 is hidden in the central residual section 8Rb, 11Rb, while now the two residual sections 8Ra, 11Ra and 8Rc, 11Rc at the ends have no direct function. Thus, it is clear that this pack can be used simultaneously for both types of lamps, irrespective of the type of their bases.

Here, the complete side wall 10 projects by about 8 mm in each case beyond the projection of the lamp upon it, which achieves a certain protective function for the lamp, see arrow S.

In a similar way, the pack also projects by about 10 mm beyond the end of the lamp at the lid-free ends, in order to protect said lamp, see arrow D.

What is claimed is:

1. A folded pack comprising:

a paper board material for an elongated object, having at least one lateral bulge, wherein the folded pack is fabricated from one piece being produced from a substantially rectangular strip of paper board material, which is folded at fold lines running transversely with respect to a longitudinal axis and spaced apart along the axis, the base part wrapping around the object to be packed by at least 360° and consisting of a front wall, a base part and two side walls for holding the object to be packed, the pack surrounding the elongated object in the shape of a parallelepiped, at least one viewing window being cut out of the front wall and one side wall, at least one edge zone of the viewing window providing a holding function for the object;

wherein the edge zone is subdivided into a strap area and an adhesive area, the strap area resting on the object to be packed and the adhesive area resting on the base part.

2. The folded pack as claimed in claim 1, wherein the viewing window runs transversely with respect to the longitudinal axis in the shape of a strip.

3. A folded pack comprising:

a paper board material for an elongated object, having at least one lateral bulge, wherein the folded pack is fabricated from one piece being produced from a substantially rectangular strip of paper board material, which is folded at fold lines running transversely with respect to a longitudinal axis and spaced apart along the axis, the base part wrapping around the object to be packed by at least 360° and consisting of a front wall, a base part and two side walls for holding the object to be packed, the pack surrounding the elongated object in the shape of a parallelepiped, at least one viewing window being cut out of the front wall and one side wall, at least one edge zone of the viewing window providing a holding function for the object;

wherein, in the region of the viewing window, the original material of the board blank is pressed onto the base and the other side wall and is therefore arranged behind the object.

4. The folded pack as claimed in claim 1, wherein, in the region of the edge zone, the material of the board blank is arranged in front of the object, the material additionally being folded along new fold lines which are different from the one original fold line, part of the original side wall which is adjacent to the base part being bent along the base part, that is to say through 180°, and this part being used as an adhesive area for the connection to the base part, while the following area rests on the object as a strap area.

5. The folded pack as claimed in claim 4, wherein one of the two edges of the edge zone forms a stop for the lateral bulge of the object.

6. The folded pack as claimed in claim 3, wherein the folded pack has two viewing windows, which are arranged in such a way that the edge zones optionally form a stop for two bulges at the ends or a central bulge.

7. A folded pack comprising:

a paper board material for an elongated object, having at least one lateral bulge, wherein the folded pack is fabricated from one piece being produced from a substantially rectangular strip of paper board material, which is folded at fold lines running transversely with respect to a longitudinal axis and spaced apart along the axis, the base part wrapping around the object to be packed by at least 360° and consisting of a front wall, a base part and two side walls for holding the object to be packed, the pack surrounding the elongated object in the shape of a parallelepiped, at least one viewing window being cut out of the front wall and one side wall, at least one edge zone of the viewing window providing a holding function for the objeet;

wherein the base part has an extended tongue with a suspension opening.

8. A folded pack comprising:

a paper board material for an elongated object, having at least one lateral bulge, wherein the folded pack is fabricated from one piece being produced from a substantially rectangular strip of paper board material, which is folded at fold lines running transversely with respect to a longitudinal axis and spaced apart along the axis, the base part wrapping around the object to be packed by at least 360° and consisting of a front wall, a base part and two side walls for holding the object to be packed, the pack surrounding the elongated object in the shape of a parallelepiped, at least one viewing window being cut out of the front wall and one side wall, at least one edge zone of the viewing window providing a holding function for the object;

wherein the base part is connected at least to the adhesive area of the one side wall by means of adhesive material.

9. A paper board blank for a folded pack as claimed in claim 1.

10. A folded pack comprising:

a paper board material for an elongated object, having at least one lateral bulge, wherein the folded pack is fabricated from one piece being produced from a substantially rectangular strip of paper board material, which is folded at fold lines running transversely with respect to its longitudinal axis and spaced apart along the axis, the base part wrapping around the object to be packed by at least 360° and consisting of a front wall, a base part and two side walls for holding the object to be packed, the pack surrounding the elongated object in the shape of a parallelepiped, at least one viewing window being cut out of the front wall and one side wall, at least one edge zone of the viewing window providing a holding function for the object;

fitted with an object, in particular a lamp having one-piece or two-part bases.

11. The folded pack as claimed in claim 1, wherein the edge zone runs transversely with respect to the longitudinal axis in the shape of a strip.

* * * * *